US010508646B2

(12) United States Patent
Tsai

(10) Patent No.: US 10,508,646 B2
(45) Date of Patent: Dec. 17, 2019

(54) MANUAL DUAL-DIRECTIONAL INFLATING DEVICE

(71) Applicant: DONGGUAN TIGER POINT, METAL & PLASTIC PRODUCTS CO., LTD., Dongguan, Guang Dong (CN)

(72) Inventor: Chun-Chung Tsai, Dongguan (CN)

(73) Assignee: DONGGUAN TIGER POINT, METAL & PLASTIC PRODUCTS CO., LTD., Dongguan (CN)

( * ) Notice: Subject to any disclaimer, the term of this patent is extended or adjusted under 35 U.S.C. 154(b) by 166 days.

(21) Appl. No.: 15/916,961

(22) Filed: Mar. 9, 2018

(65) Prior Publication Data

US 2019/0277271 A1 Sep. 12, 2019

(51) Int. Cl.

| | |
|---|---|
| ***F04B 33/00*** | (2006.01) |
| ***F04B 27/00*** | (2006.01) |
| ***F04B 39/00*** | (2006.01) |
| ***F04B 35/06*** | (2006.01) |
| ***F04B 27/10*** | (2006.01) |

(52) U.S. Cl.

CPC ..... *F04B 33/005* (2013.01); *F04B 27/005* (2013.01); *F04B 27/1009* (2013.01); *F04B 27/1036* (2013.01); *F04B 33/00* (2013.01); *F04B 35/06* (2013.01); *F04B 39/0016* (2013.01)

(58) Field of Classification Search

CPC ..... F04B 33/005; F04B 33/00; F04B 27/005; F04B 27/1009; F04B 27/1036; F04B 27/24

See application file for complete search history.

(56) References Cited

U.S. PATENT DOCUMENTS

| | | | | |
|---|---|---|---|---|
| 4,508,490 A * | 4/1985 | Ramirez | ..... | F04B 33/00 417/234 |
| 6,120,265 A | 9/2000 | Wu | | |
| 6,257,849 B1 * | 7/2001 | Wu | ..... | F04B 33/005 417/238 |

(Continued)

FOREIGN PATENT DOCUMENTS

| | | |
|---|---|---|
| EP | 3171024 A1 | 5/2017 |
| GB | 179971 A | 5/1922 |
| GB | 217520 A | 6/1924 |

OTHER PUBLICATIONS

EPO Office Action dated Jul. 27, 2018, [EP 18162091.5].

*Primary Examiner* — Bryan M Lettman
*Assistant Examiner* — Timothy P Solak
(74) *Attorney, Agent, or Firm* — Rabin & Berdo, P.C.

(57) ABSTRACT

The inflating device has a body, a large cylinder, a small cylinder, a handle, and a switching mechanism. The large cylinder is mounted moveably in the body and has an upper input gap, an inner bottom base, and a bottom base. The upper input gap is defined between an outer surface of a bottom end of the large cylinder and an inner surface of a first chamber of the body. The bottom base is connected with the large cylinder, is located below the inner bottom base, and has a first annular holding recess and a first O-ring. The small cylinder is mounted moveably in a second chamber of the large cylinder and has a piston base. The handle is mounted on the top end of the small cylinder. The switching mechanism is mounted on the top end of the large cylinder.

7 Claims, 9 Drawing Sheets

(56) References Cited

U.S. PATENT DOCUMENTS

| | | | | |
|---|---|---|---|---|
| 2003/0086802 | A1* | 5/2003 | Tsai | F04B 33/00 417/564 |
| 2007/0221056 | A1* | 9/2007 | Kutella | F04B 3/003 92/61 |
| 2015/0337821 | A1 | 11/2015 | Yang et al. | |

* cited by examiner

MANUAL DUAL-DIRECTIONAL INFLATING DEVICE

BACKGROUND OF THE INVENTION

1. Field of the Invention

The present invention relates to an inflating device, and more particularly to a manual dual-directional inflating device that can supply compressed air in dual directions.

2. Description of Related Art

An inflating device is applied to inflate a tire of a bicycle or a motorcycle or a ball. To inflate an inflatable object in a flat state with an inflating device having a large volume, the inflating speed is high in a low resistance. When the inflatable object is almost completely inflated, the inflatable object has a high pressure inside, so a high resistance will occur when the object is inflated with the inflating device having a large volume. When the object is inflated with an inflating device that has a small volume, a smaller resistance is generated so that the object is easily inflated.

A conventional inflating device comprises a large pump and a small pump combined with each other, such that the conventional inflating device is convenient for use. However, the conventional inflating device can only inflate an object in a unidirectional manner, so the conventional inflating device cannot inflate an object rapidly. In addition, a switch is easily touched during the operation of the conventional inflating device, so the large pump and the small pump will be switched to each other unintentionally and the conventional inflating device is inconvenient in use.

To overcome the shortcomings, the present invention tends to provide an inflating device to mitigate or obviate the aforementioned problems.

SUMMARY OF THE INVENTION

The main objective of the invention is to provide an inflating device that can supply compressed air in dual directions.

The inflating device has a body, a large cylinder, a small cylinder, a handle, and a switching mechanism. The body has a first chamber, a foot step, a top cap, a first inlet, a first check valve, a second inlet, and a second check valve. The first chamber is defined in the body. The foot step is mounted on a bottom end of the body. The top cap is mounted on a top end of the body. The first inlet is defined in the top cap and communicates with the first chamber. The first check valve is mounted in the body and is disposed between the first chamber and the first inlet. The second inlet is defined in the body and communicates with the first chamber. The second check valve is mounted in the body and is disposed between the first chamber and the second inlet. The large cylinder is mounted moveably in the first chamber of the body and has a top end, a second chamber, an upper input gap, an inner bottom base, and a bottom base. The top end of the large cylinder extends out of the top cap. The second chamber is defined in the large cylinder. The upper input gap is defined between an outer surface of a bottom end of the large cylinder and an inner surface of the first chamber. The inner bottom base is mounted on the bottom end of the large cylinder and has a third inlet and a third check valve. The third inlet is defined in the inner bottom base and communicates with the second chamber. The third check valve is mounted in the third inlet. The bottom base is connected with the large cylinder, is located below the inner bottom base, and has an outer surface, an input passage, a first annular holding recess, and a first O-ring. The outer surface of the bottom base is spaced from the inner surface of the first chamber to define a lower input gap between the outer surface of the bottom base and the inner surface of the first chamber. The input passage is defined between the inner bottom base and the bottom base and communicates with the third inlet. The first annular holding recess is defined around and communicates with the input passage. The first O-ring is mounted moveably in the first annular holding recess. The small cylinder is mounted moveably in the second chamber of the large cylinder and has a top end, a third chamber, and a piston base. The top end of the small cylinder extends out of the top end of the large cylinder. The third chamber is defined in the small cylinder. The piston base is hollow, is mounted on a bottom end of the small cylinder, and has a bottom cover, a second annular holding recess, a second O-ring, a fourth inlet, and a fourth check valve. The second annular holding recess is defined around the piston base. The second O-ring is mounted in the second annular holding recess. The fourth inlet is defined in the bottom cover and communicates with the second chamber and the third chamber. The fourth check valve is mounted in the fourth inlet. The handle is mounted on the top end of the small cylinder and has an outlet defined in the handle and communicating with the third chamber of the small cylinder. The switching mechanism is mounted on the top end of the large cylinder.

Other objects, advantages and novel features of the invention will become more apparent from the following detailed description when taken in conjunction with the accompanying drawings.

DETAILED DESCRIPTION OF PREFERRED EMBODIMENT

Figure 1:
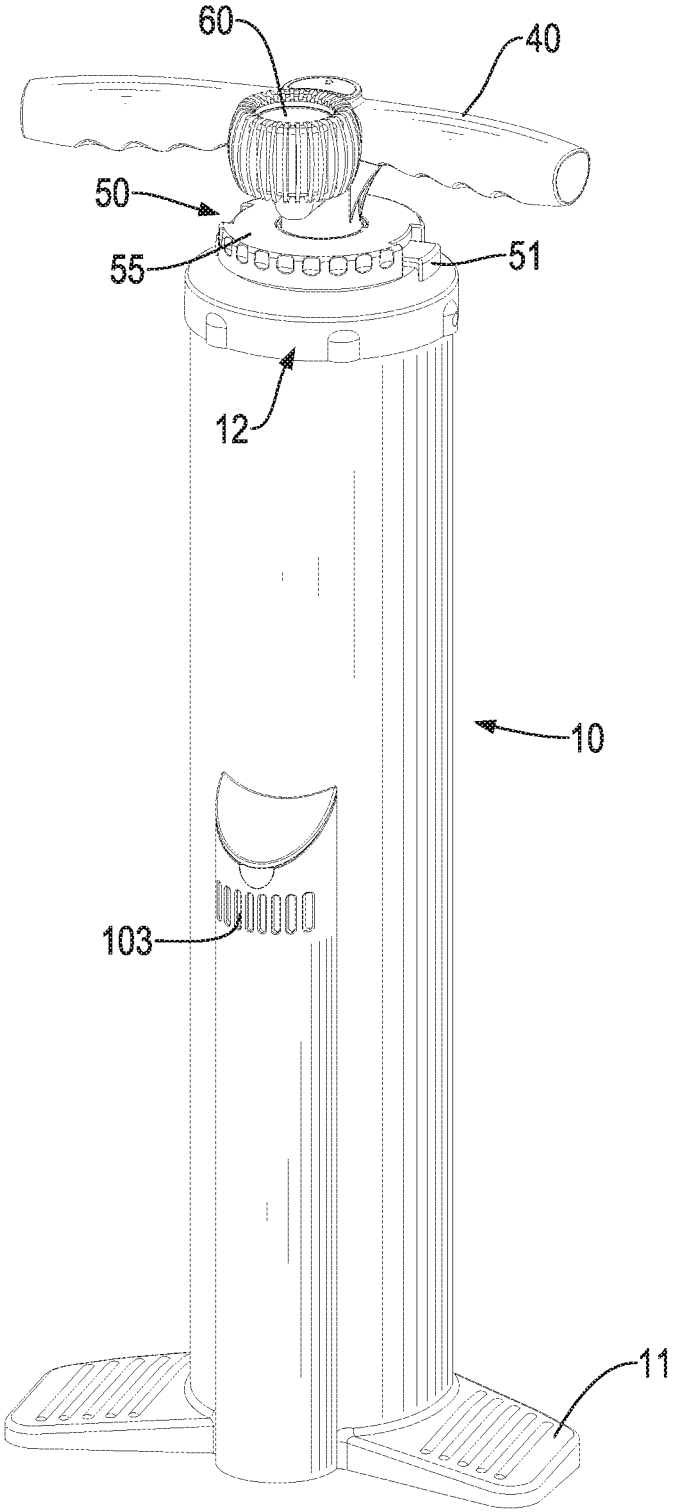
FIG. 1 is a perspective view of an inflating device in accordance with the present invention.
Figure 2:
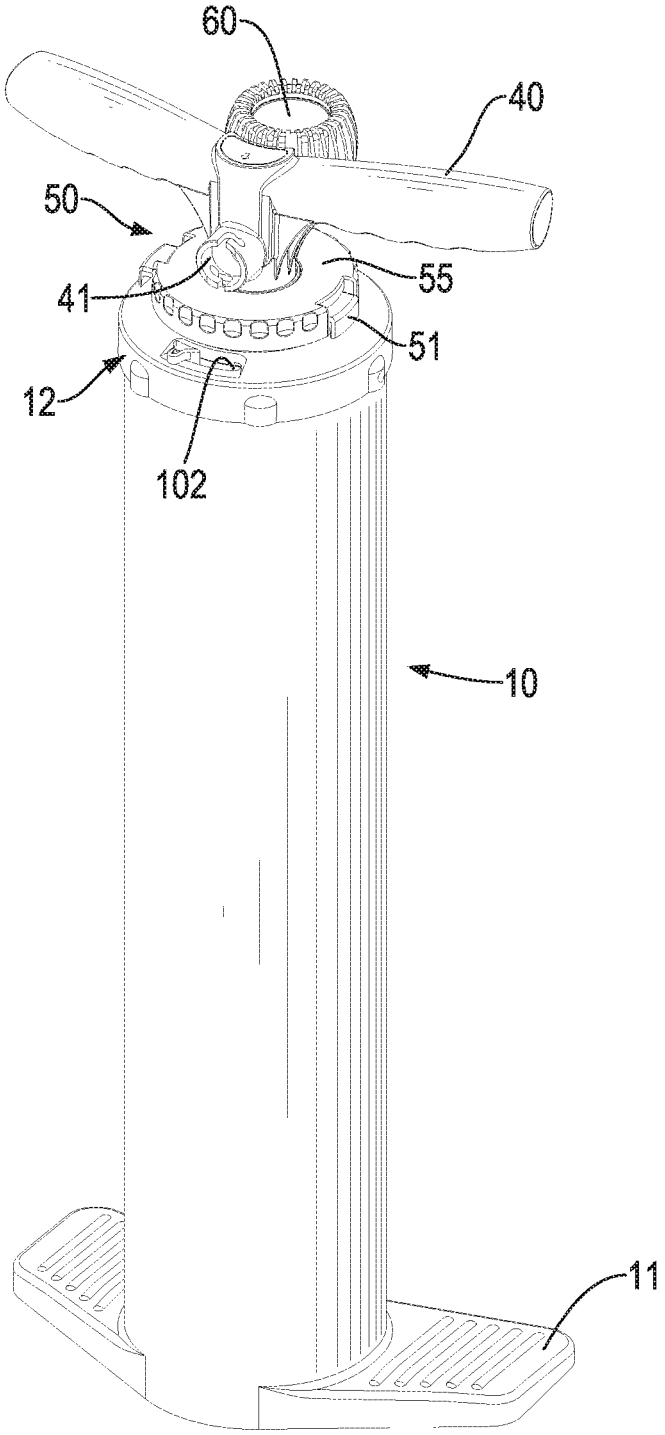
FIG. 2 is another perspective view of the inflating device in FIG. 1.

With reference to FIGS. 1 to 5, an inflating device in accordance with the present invention comprises a body 10, a larger cylinder 20, a small cylinder 30, a handle 40, and a switching mechanism 50.

The body 10 is elongated and hollow and has a first chamber 101, a foot step 11, a top cap 12, a first inlet 102, and a second inlet 103. The first chamber 101 is defined in the body 10. The foot step 11 is mounted on a bottom end of the body 10. The top cap 12 is mounted on a top end of the body 10. The first inlet 102 is defined in the top cap 12 and communicates with the first chamber 101. A first check valve 13 is mounted in the body 10 and is disposed between the first chamber 101 and the first inlet 102. The second inlet 103 is defined in the body 10 and communicates with the first chamber 101. A second check valve 14 is mounted in the body 10 and is disposed between the first chamber 101 and the second inlet 103.

Figure 7:
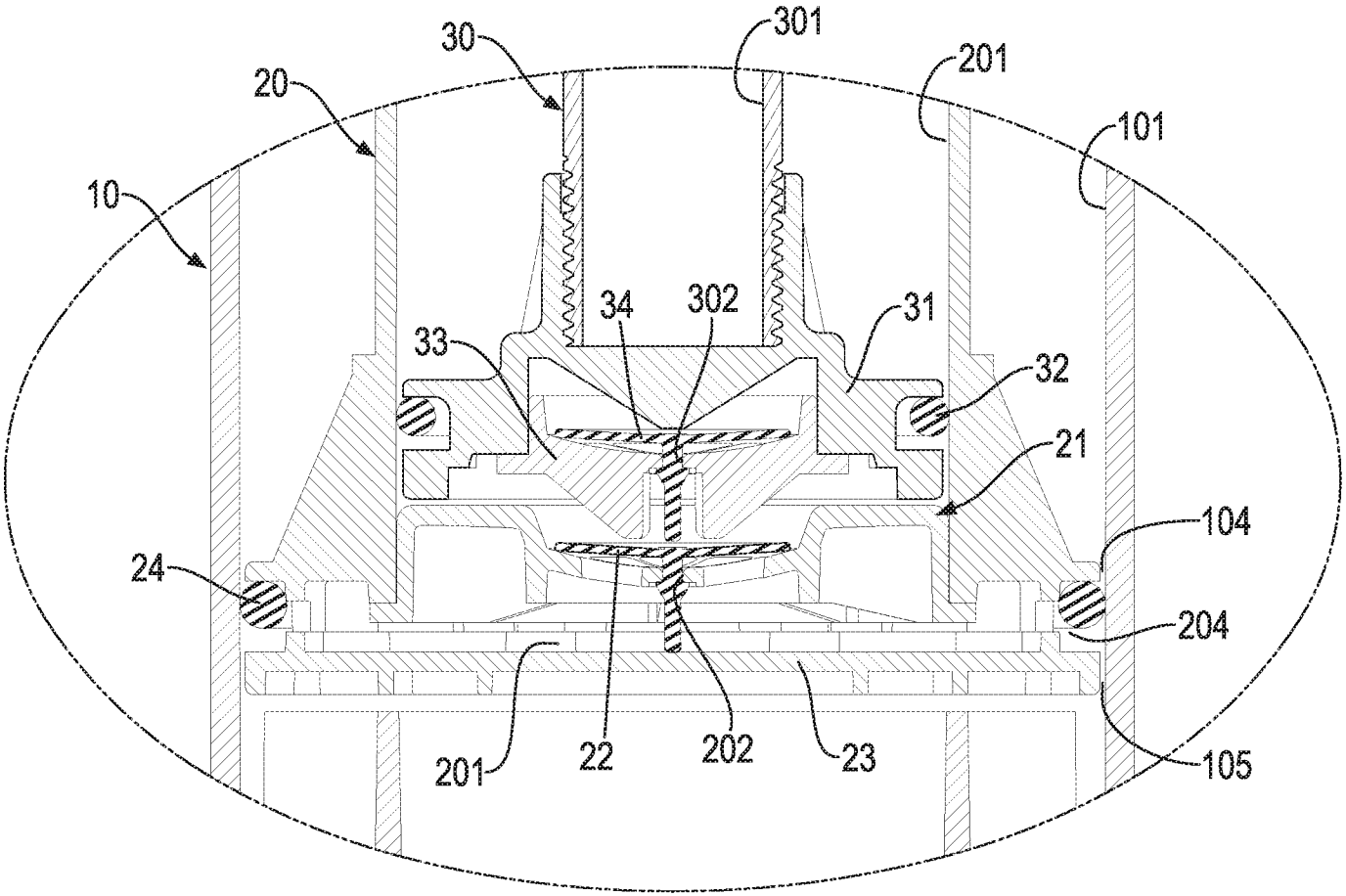
FIG. 7 is another enlarged cross sectional front view of the inflating device in FIG. 5.

With further reference to FIG. 7, the large cylinder 20 is mounted moveably in the first chamber 101 and has a top end, a bottom end, an outer surface, a second chamber 201, an inner bottom base 21. The top end of the large cylinder 20 extends out of the top cap 12. The outer surface at the bottom end of the large cylinder 20 is spaced from an inner surface of the first chamber 101 to define an upper input gap 104 between the outer surface of the larger cylinder 20 and the inner surface of the first chamber 101. The second chamber 201 is defined in the large cylinder 20. The inner bottom base 21 is mounted on the bottom end of the large cylinder 20 and has a third inlet 202 defined in the inner bottom base 21 and communicates with the second chamber 201. A third check valve 22 is mounted in the third inlet 202.

A bottom base 23 is mounted in the first chamber 101, is connected with the bottom of the large cylinder 20, and is located below the inner bottom base 21. The bottom base 23 has an outer surface spaced from the inner surface of the first chamber 101 to define a lower input gap 105 between the outer surface of the bottom base 23 and the inner surface of the first chamber 101. An input passage 203 is defined between the inner bottom base 21 and the bottom base 23 and communicates with the third inlet 202. A first annular holding recess 204 is defined around and communicates with the input passage 203. A first O-ring 24 is mounted moveably in the first annular holding recess 204. The upper input gap 104 and the lower input gap 105 communicate with the first annular holding recess 204.

The small cylinder 30 is mounted moveably in the second chamber 201 and has a top end, a bottom end, a third chamber 301, and a piston base 31. The top end of the small cylinder 30 is mounted through and extends out of the top end of the large cylinder 20. The piston base 31 is mounted on the bottom end of the small cylinder 30. A second annular holding recess is defined around the piston base 31, and a second O-ring 32 is mounted in the second annular holding recess. The piston base 31 is hollow and has a bottom cover 33, a fourth inlet 302 and a fourth check valve 34. The fourth inlet 302 is defined in the bottom cover 33 and communicates with the second chamber 201 and the third chamber 301. The fourth check valve 34 is mounted in the fourth inlet 302.

The handle 40 is mounted on the top end of the small cylinder 30 and is located above the top cap 12. The handle 40 has an outlet 41 and a pressure gauge 60. The outlet 41 is defined in the handle 40 and communicates with the third chamber 301. The pressure gauge 60 is mounted on the handle 40 and communicates with the third chamber 301.

Figure 3:
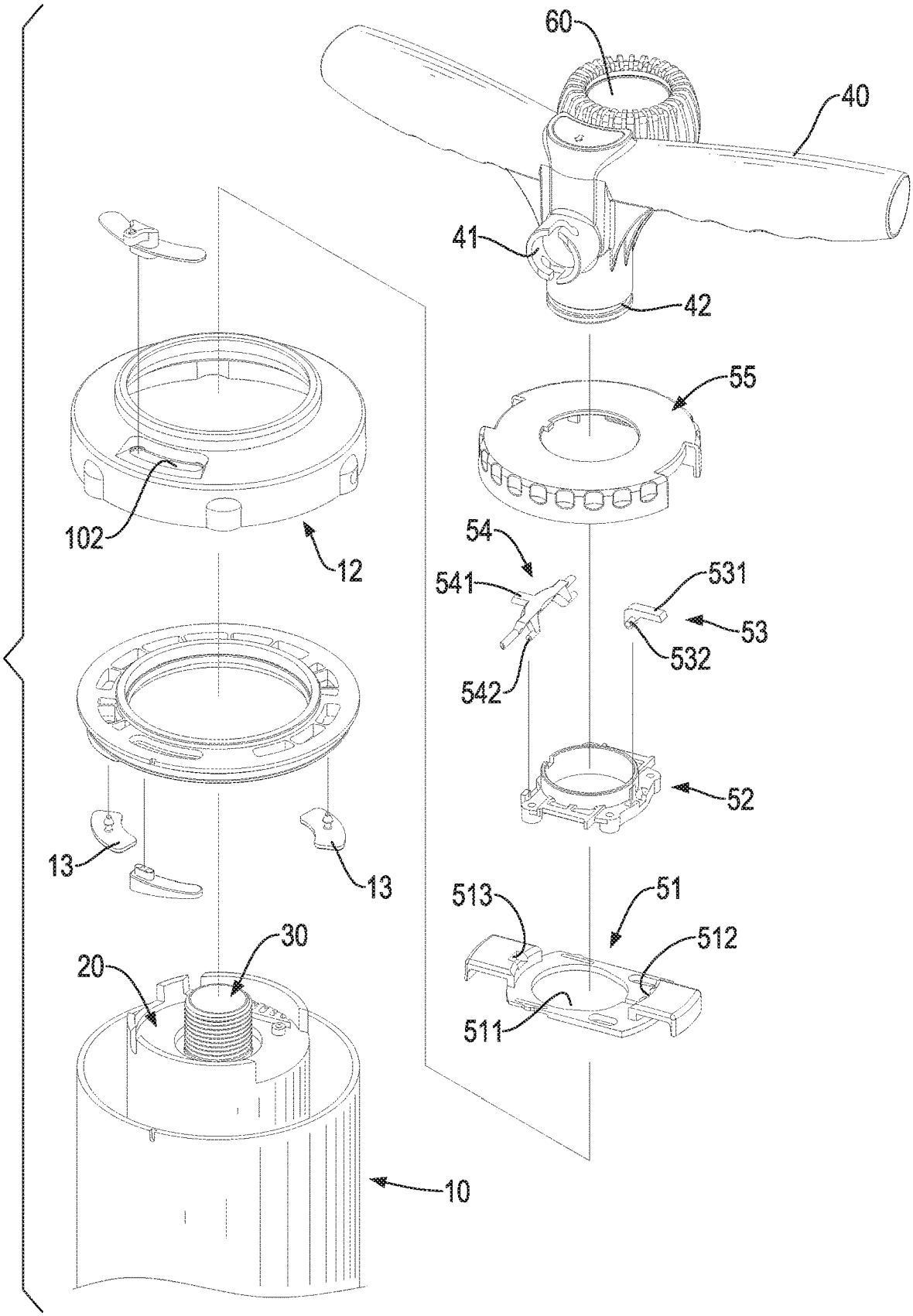
FIG. 3 is an enlarged exploded perspective view of the inflating device in FIG. 1.
Figure 4:
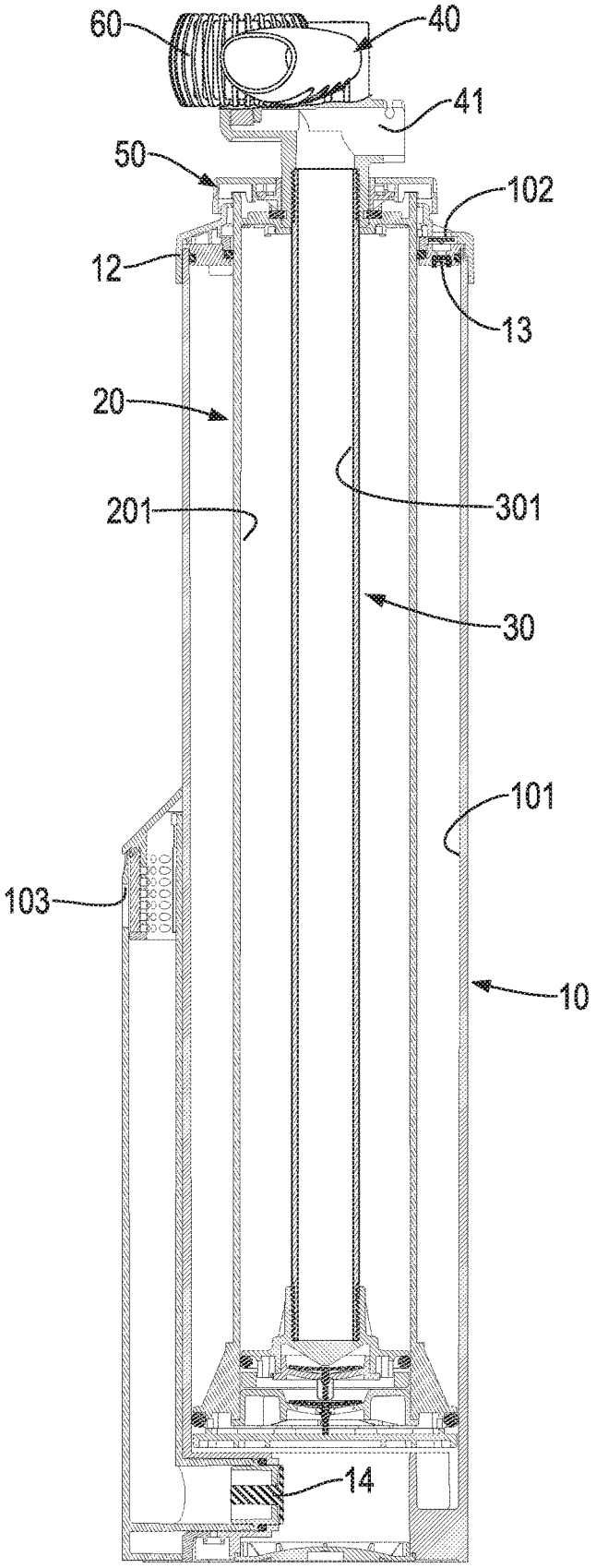
FIG. 4 is a cross sectional side view of the inflating device in FIG. 1.
Figure 5:
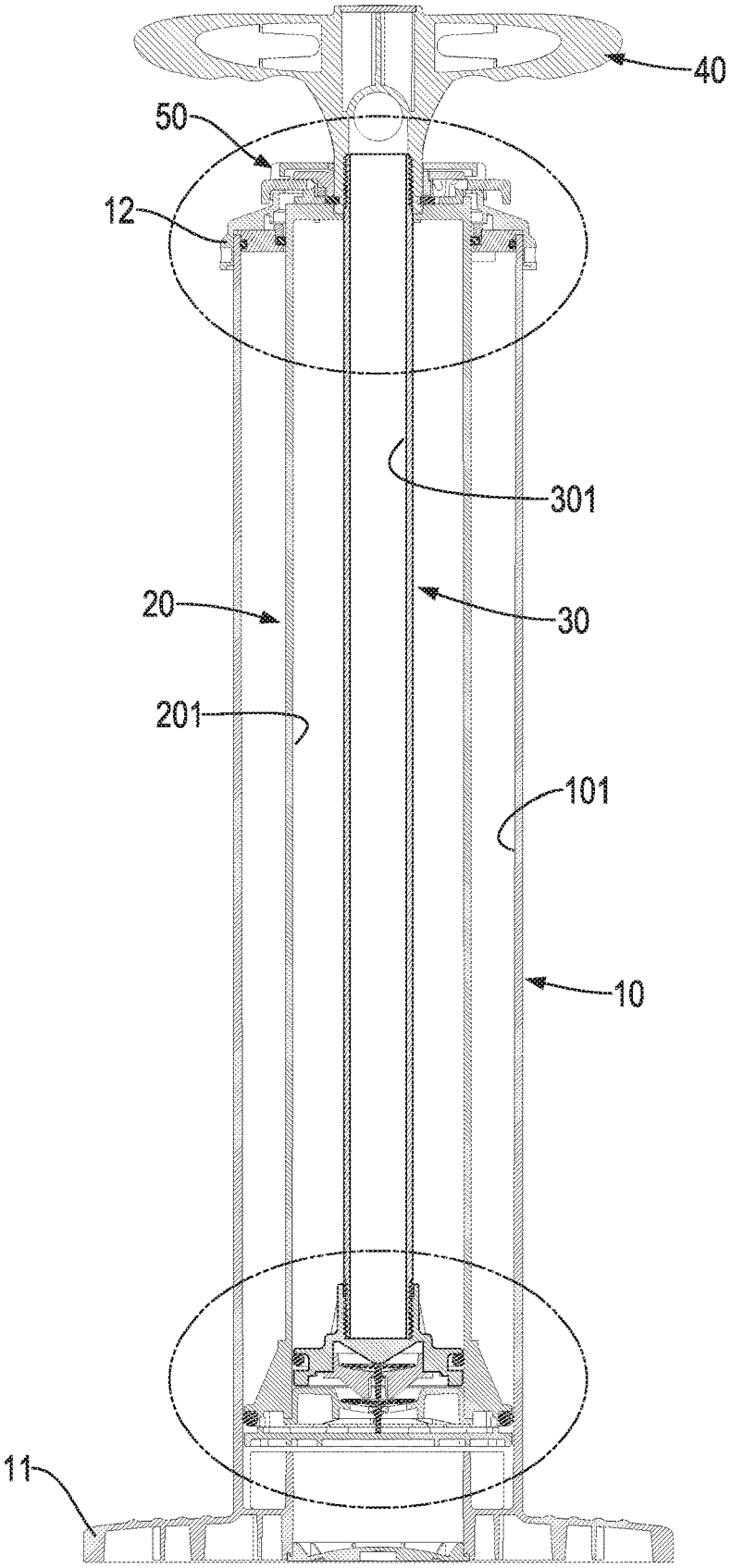
FIG. 5 is a cross sectional front view of the inflating device in FIG. 1.
Figure 6:
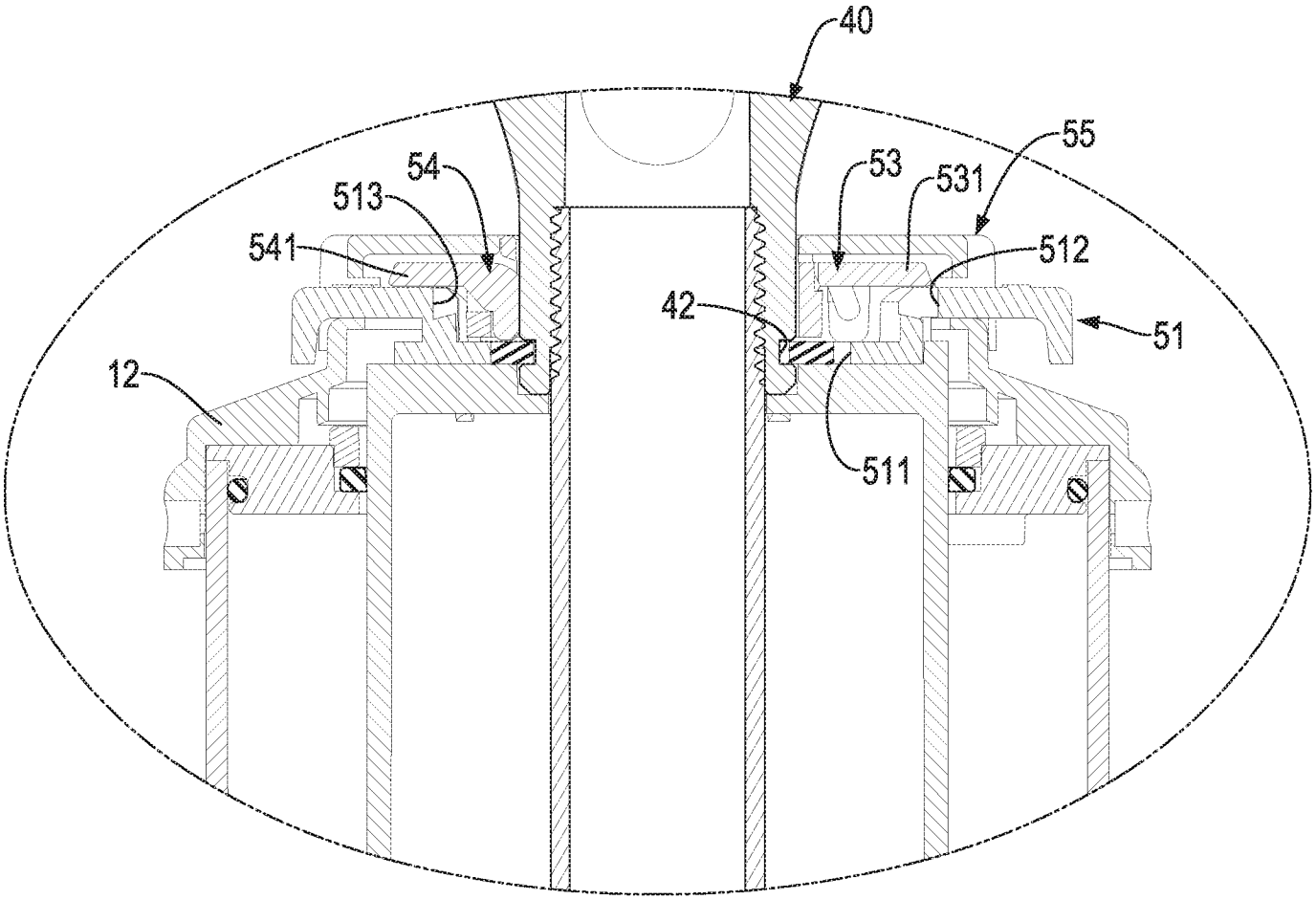
FIG. 6 is an enlarged cross sectional front view of the inflating device in FIG. 5.

With reference to FIGS. 3 and 6, the switching mechanism 50 is mounted on the top end of the large cylinder 20 and comprises a switching block 51, a holding collar 52, a first limiting member 53, a second limiting member 54, and a top cover 55. The switching block 51 is mounted moveably on the top end of the large cylinder 20 and has an engaging portion 511 formed on the switching block 51 and engaged with an engaging recess 42 defined in the handle 40. The holding collar 52 is mounted securely on the top end of the large cylinder 20 and presses against the switching block 51. The first limiting member 53 is mounted pivotally on the holding collar 52 and comprises a first limiting segment 531 and a first pivotal segment 532. The first limiting segment 531 is formed on an end of the first limiting member 53. The first pivotal segment 532 is formed on the first limiting member 53 and is pivotally connected with the holding collar 52. The second limiting member 54 is mounted pivotally on the holding collar 52 and comprises a second limiting segment 541 and a second pivotal segment 542. The second limiting segment 541 is formed on a middle portion of the second limiting member 54. The second pivotal segment 542 is formed on the second limiting member 54 and is pivotally connected with the holding collar 52. The top cover 55 is located above the holding collar 52 and covers the first limiting member 53 and the second limiting member 54. Two ends of the switching block 51 extend respectively out of two sides of the top cover 55. In addition, the switching block 51 further has a first limiting recess 512 and a second limiting recess 513 for engaging respectively with the first limiting member 53 and the second limiting member 54 inside.

To inflate an object with the small cylinder 30, the switching block 51 is pushed to engage with the body 10 such that the larger cylinder 20 is kept from moving. At this time, the first limiting segment 531 on the first limiting member 53 is engaged with the first limiting recess 512 due to the gravity. When the handle 40 is pulled upward and the small cylinder 30 is moved upward, air will be sucked into the first chamber 101 via the first inlet 102. The air then enters into the second chamber 201 via the upper input gap 104, the first annular holding recess 204, the input passage 203, and the third inlet 202. When the handle 40 is pushed downward, the third check valve 22 is closed and the fourth check valve 34 is opened such that the air in the second chamber 201 will enter into the third chamber 301 via the fourth inlet 302. The air in the third chamber 301 will be pushed into the inflatable object via the outlet 41. While the small cylinder 30 is moved, the switching block 51 is locked and is prevented from moving. When the small cylinder 30 is moved to a lowest position, the first limiting member 53 can be pivoted to disengage the first limiting segment 531 from the first limiting recess 512. Thus, the switching block 51 is unlocked and can be moved.

Figure 8:
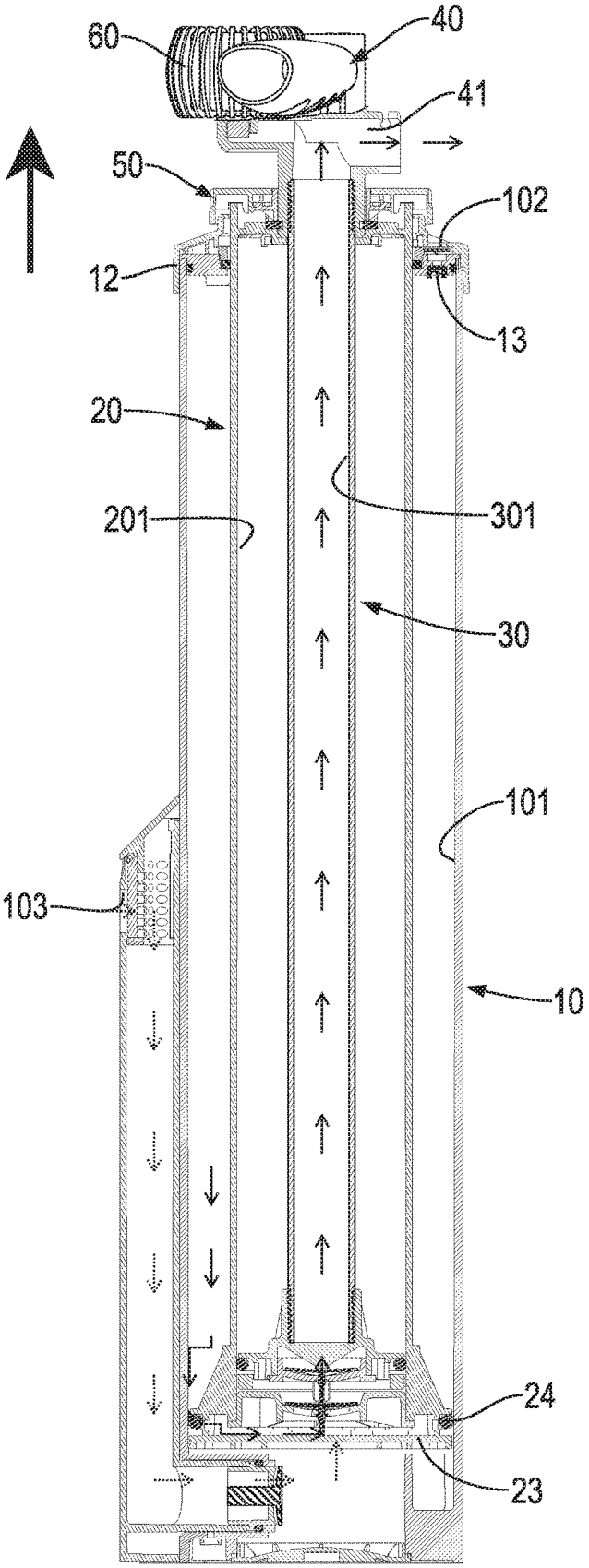
FIG. 8 is an operational cross sectional side view of the inflating device in FIG. 1.

With reference to FIGS. 7 and 8, to inflate an object with the large cylinder 20, the switching block 51 is pushed to disengage from the body 10 and to engage with the engaging recess 42 in the handle 40 such that the large cylinder 20 is moveable with the small cylinder 30. At this time, the second limiting segment 541 of the second limiting member 54 is engaged with the second limiting recess 513 due to the gravity. When the handle 40 is pulled upward, the small cylinder 30 and the large cylinder 20 are moved upward together.

The air in the first chamber 101 above the bottom base 23 will be pushed into the third chamber 301 via the upper input gap 104, the first annular holding recess 204, the input passage 203, the third inlet 202, and the fourth inlet 302. The original air in the third chamber 301 will be pushed into the inflatable object via the outlet 41. At this time, the first O-ring 24 abuts the top surface of the bottom base 23, so the air in the first chamber 101 above the bottom base 23 is kept from passing through the lower input gap 105 and from entering the space in the first chamber 101 below the bottom base 23. The air outside the body 10 will be sucked into the space of the first chamber 101 below the bottom base 23 via the second inlet 103.

Figure 9:
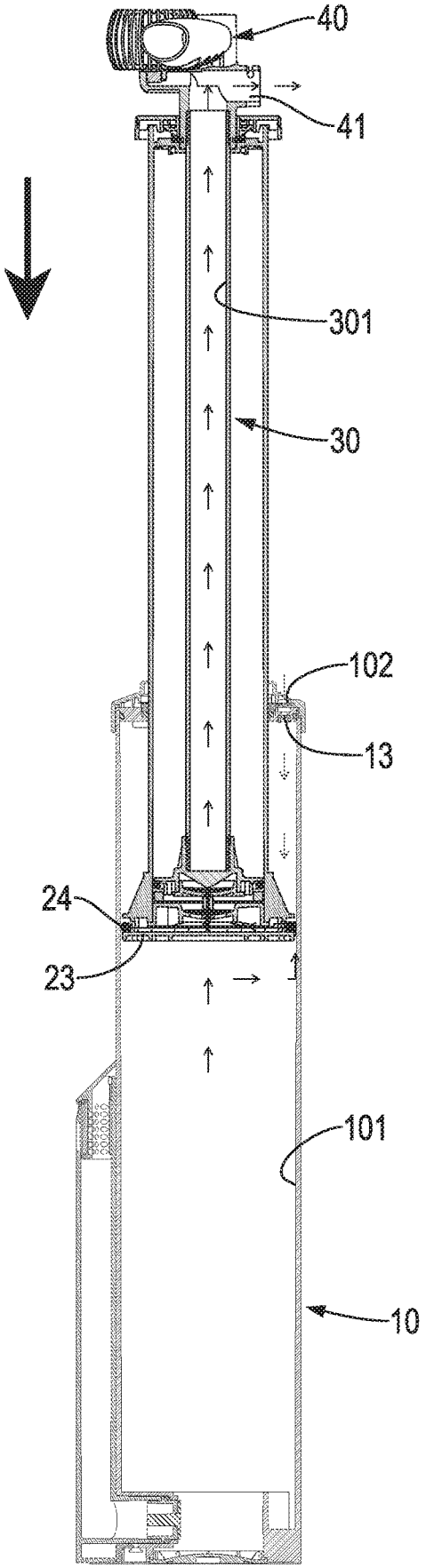
FIG. 9 is another operational cross sectional side view of the inflating device in FIG. 1.

With reference to FIGS. 7 and 9, when the handle 40 is pushed downward, the O-ring 24 will be moved upward in the first annular holding recess 204. The air in the first chamber 101 below the bottom base 23 will be pushed into the third chamber 301 via the lower input gap 105, the first annular holding recess 204, the input passage 203, the third inlet 202, and the fourth inlet 302, and the air in the third chamber 301 is pushed to inflate the object via the outlet 41. At this time, the air outside the body 10 will be sucked into the space of the first chamber 101 above the bottom base 23 via the first inlet 102. Accordingly, the object can be inflated both in the upward and downward movements of the handle 40.

While the small cylinder 30 is moved, the switching block 51 is locked and is prevented from moving. When the small cylinder 30 is moved to a lowest position, the second limiting member 54 can be pivoted to disengage the second limiting segment 541 from the second limiting recess 513. Thus, the switching block 51 is unlocked and can be moved.

With such an arrangement, the inflating device in accordance with the present invention can inflate an object by the large cylinder in both directions, i.e. upward and downward movements, such that the inflating efficiency of the inflating device is improved. In addition, because the switching block 51 is locked by the first limiting member 53 or the second limiting member 54 during the operation of the inflating device, the switching block 51 cannot be moved unintentionally. Furthermore, with the arrangement of the pressure gauge 60, the pressures in the third chamber 301 can be shown on the pressure gauge 60 to a user.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An inflating device comprising:

a body having
- a first chamber defined in the body;
- a foot step mounted on a bottom end of the body;
- a top cap mounted on a top end of the body;
- a first inlet defined in the top cap and communicating with the first chamber;
- a first check valve mounted in the body and disposed between the first chamber and the first inlet;
- a second inlet defined in the body and communicating with the first chamber; and
- a second check valve mounted in the body and disposed between the first chamber and the second inlet;

a large cylinder mounted moveably in the first chamber of the body and having
- a top end extending out of the top cap;
- a second chamber defined in the large cylinder;
- an upper input gap defined between an outer surface of a bottom end of the large cylinder and an inner surface of the first chamber;
- an inner bottom base mounted on the bottom end of the large cylinder and having
  - a third inlet defined in the inner bottom base and communicating with the second chamber; and
  - a third check valve mounted in the third inlet;
- a bottom base connected with the large cylinder, located below the inner bottom base, and having
  - an outer surface spaced from the inner surface of the first chamber to define a lower input gap between the outer surface of the bottom base and the inner surface of the first chamber;
  - an input passage defined between the inner bottom base and the bottom base and communicating with the third inlet;
  - a first annular holding recess defined around and communicating with the input passage; and
  - a first O-ring mounted moveably in the first annular holding recess;

a small cylinder mounted moveably in the second chamber of the large cylinder and having
- a top end extending out of the top end of the large cylinder;
- a third chamber defined in the small cylinder; and
- a piston base being hollow, mounted on a bottom end of the small cylinder, and having
  - a bottom cover;
  - a second annular holding recess defined around the piston base;
  - a second O-ring mounted in the second annular holding recess;
  - a fourth inlet defined in the bottom cover and communicating with the second chamber and the third chamber; and
  - a fourth check valve mounted in the fourth inlet;

a handle mounted on the top end of the small cylinder and having an outlet defined in the handle and communicating with the third chamber of the small cylinder; and
- a switching mechanism mounted on the top end of the large cylinder.

2. The inflating device as claimed in claim 1, wherein the switching mechanism comprises
- a switching block mounted moveably on the top end of the large cylinder and having an engaging portion; and
- a holding collar mounted securely on the top end of the large cylinder and pressing against the switching block; and the handle has an engaging recess defined in the handle and selectively engaged with the engaging portion on the switching block.

3. The inflating device as claimed in claim 2, wherein the switching mechanism further comprises
- a first limiting member pivotally mounted on the holding collar and having a first limiting segment; and
- a second limiting member pivotally mounted on the holding collar and having a second limiting segment; and the switching block has
- a first limiting recess defined in the switching block and selectively engaged with the first limiting segment of the first limiting member; and
- a second limiting recess defined in the switching block and selectively engaged with the second limiting segment of the second limiting member.

4. The inflating device as claimed in claim 3, wherein the switching mechanism further comprises a top cover located above the holding collar and covering the first limiting member and the second limiting member; and
- two ends of the switching block extend respectively out of two sides of the top cover.

5. The inflating device as claimed in claim 3, wherein the first limiting member has a first pivotal segment formed on the first limiting member and pivotally connected with the holding collar.

6. The inflating device as claimed in claim 3, wherein the second limiting member has a second pivotal segment formed on a middle of the second limiting member and pivotally connected with the holding collar.

7. The inflating device as claimed in claim 3, wherein the handle further comprises a pressure gauge mounted on the handle and communicating with the third chamber.

* * * * *